US012492709B2

(12) United States Patent
Amano

(10) Patent No.: US 12,492,709 B2
(45) Date of Patent: Dec. 9, 2025

(54) CENTRIFUGAL COMPRESSOR

(71) Applicant: MITSUBISHI HEAVY INDUSTRIES COMPRESSOR CORPORATION, Hiroshima (JP)

(72) Inventor: Tetsuo Amano, Hiroshima (JP)

(73) Assignee: MITSUBISHI HEAVY INDUSTRIES COMPRESSOR CORPORATION, Hiroshima (JP)

( * ) Notice: Subject to any disclaimer, the term of this patent is extended or adjusted under 35 U.S.C. 154(b) by 0 days.

(21) Appl. No.: 19/032,972

(22) Filed: Jan. 21, 2025

(65) Prior Publication Data

US 2025/0243874 A1 Jul. 31, 2025

(30) Foreign Application Priority Data

Jan. 31, 2024 (JP) ..... 2024-012861

(51) Int. Cl.
*F04D 29/42* (2006.01)
*F04D 17/12* (2006.01)

(52) U.S. Cl.
CPC ..... *F04D 29/4206* (2013.01); *F04D 17/122* (2013.01)

(58) Field of Classification Search
CPC .... F04D 17/00; F04D 17/112; F04D 29/2222; F04D 29/4206; F04D 29/441; F05D 2230/50; F05D 2230/51; F05D 2230/60; F05D 2230/61
See application file for complete search history.

(56) References Cited

U.S. PATENT DOCUMENTS 3,856,430 A * 12/1974 Langham ..... F04D 29/682 415/207
3,927,763 A * 12/1975 Strub ..... F04D 17/125 206/319
3,976,395 A * 8/1976 Kalnin ..... F04D 17/125 415/230

(Continued)

FOREIGN PATENT DOCUMENTS

EP 3239534 A1 11/2017
FR 2552501 A1 * 3/1985 ..... F04D 29/441
IT 1050897 B * 3/1981 ..... F04D 1/063

*Primary Examiner* — Courtney D Heinle
*Assistant Examiner* — Ryan C Clark
(74) *Attorney, Agent, or Firm* — Osha Bergman Watanabe & Burton LLP

(57) ABSTRACT

A centrifugal compressor includes a rotor shaft including an impeller and a casing including a suction port and a discharge port. The casing includes a diaphragm that covers the rotor shaft, an outer casing that covers the diaphragm, a discharge scroll that guides a working fluid discharged from the impeller to the discharge port, and a flow path forming member including a scroll outer circumferential surface that is located on an outer side in a radial direction and faces an inner side in the radial direction in the discharge scroll. The rotor shaft and the diaphragm form a bundle that is accommodated in the outer casing in an insertable and removable state. The flow path forming member is formed to have an outside diameter smaller than an outside diameter of the bundle in the radial direction, extends in a circumferential direction, and is fixed to the diaphragm from an axial direction.

5 Claims, 3 Drawing Sheets

(56) References Cited

U.S. PATENT DOCUMENTS

| | | | | |
|---|---|---|---|---|
| 4,579,509 | A * | 4/1986 | Jacobi | F04D 29/441 415/199.1 |
| 4,966,523 | A * | 10/1990 | Sherikar | F04D 29/441 415/208.4 |
| 5,087,172 | A * | 2/1992 | Ferri | F04D 17/125 277/374 |
| 7,513,735 | B2 * | 4/2009 | Sarri | F04D 29/624 415/199.1 |
| 9,638,196 | B2 * | 5/2017 | Yoshida | F04D 29/4206 |
| 10,364,820 | B1 * | 7/2019 | Oda | F04D 29/622 |
| 2013/0272853 | A1 * | 10/2013 | Shinohara | F04D 17/12 415/170.1 |
| 2016/0333905 | A1 * | 11/2016 | Husted | F04D 29/441 |
| 2018/0017073 | A1 * | 1/2018 | Yamada | F04D 29/422 |
| 2018/0135647 | A1 * | 5/2018 | Okada | F04D 29/284 |
| 2018/0372121 | A1 * | 12/2018 | Higuchi | F04D 29/441 |
| 2019/0063457 | A1 * | 2/2019 | Nakaniwa | F04D 29/441 |
| 2020/0056617 | A1 * | 2/2020 | Okada | F04D 29/5853 |
| 2020/0248713 | A1 * | 8/2020 | Oda | F01D 25/265 |
| 2021/0131444 | A1 * | 5/2021 | Oishi | F04D 29/053 |
| 2021/0239129 | A1 * | 8/2021 | Yamashita | F04D 29/441 |
| 2021/0404481 | A1 * | 12/2021 | Yagi | F01D 5/043 |

* cited by examiner

CENTRIFUGAL COMPRESSOR

CROSS-REFERENCE TO RELATED APPLICATIONS

This application claims the benefit of priority to Japanese Patent Application Number 2024-012861 filed on Jan. 31, 2024. The entire contents of the above-identified application are hereby incorporated by reference.

TECHNICAL FIELD

The disclosure relates to a centrifugal compressor.

RELATED ART

A multistage centrifugal compressor including a plurality of stages of impellers for compressing gas is known as a type of centrifugal compressor. The multistage centrifugal compressor sequentially compresses gas sucked into a casing from a suction port by the plurality of stages of impellers and discharges the compressed gas to the outside of the casing from a discharge port. The discharge port is connected to a discharge scroll that maintains a constant flow velocity of the gas discharged from the impellers through a diffuser flow path and reduces the pressure of the gas.

For example, EP 3239534 A1 describes a discharge volute (discharge scroll) formed so as to gradually increase in spacing in a radial direction toward a downstream side in a flow direction of gas in a circumferential direction. The discharge volute is formed by fixing, to a casing, a volute piece whose wall thickness dimension in the radial direction gradually decreases toward the downstream side in the flow direction of the gas in the circumferential direction.

SUMMARY

In the structure described in EP 3239534 A1, the volute piece is fixed from the radial direction to a casing main body covering a bundle. When the size of the discharge scroll is reduced, the shape of the volute piece is enlarged. As a result, the protrusion amount of the volute piece protruding from the inner circumferential surface of the casing main body increases. Since the bundle including a diaphragm is inserted in the casing main body, the enlarged volute piece may interfere with the bundle. As a result, the assemblability of the centrifugal compressor is affected. Therefore, it is desired to prevent the assemblability of a centrifugal compressor including a bundle from being affected regardless of how the size of a discharge scroll is changed.

The disclosure has been made to solve the above-described problem, and an object of the disclosure is to provide a centrifugal compressor that can help prevent the assemblability of the centrifugal compressor including a bundle from being affected regardless of how the size of a discharge scroll is changed.

To solve the above-described problem, a centrifugal compressor according to the disclosure includes a rotor shaft extending in an axial direction in which a central axis extends, and a casing including a suction port formed on a first side in the axial direction and a discharge port formed on a second side in the axial direction. The rotor shaft includes an impeller disposed inside the casing and configured to compress a working fluid supplied from the first side in the axial direction and discharge the compressed working fluid to an outer side in a radial direction with respect to the central axis. The casing includes a diaphragm formed in a tubular shape extending in the axial direction so as to cover the rotor shaft, an outer casing formed in a tubular shape extending in the axial direction so as to cover the diaphragm, a diffuser flow path configured to guide the working fluid discharged from the impeller toward the outer side in the radial direction, a discharge scroll configured to guide the working fluid discharged from the impeller to the discharge port, and a flow path forming member including a scroll outer circumferential surface, the scroll outer circumferential surface being located on the outer side in the radial direction and facing an inner side in the radial direction in the discharge scroll. The discharge scroll is connected to the diffuser flow path on the outer side in the radial direction and extends in a circumferential direction about the central axis. The rotor shaft and the diaphragm form a bundle formed in a columnar shape extending in the axial direction, the bundle being accommodated in the outer casing in a state of being insertable and removable in the axial direction on the inner side in the radial direction. The flow path forming member is formed to have an outside diameter smaller than an outside diameter of the bundle in the radial direction, extends in the circumferential direction, and is fixed to the diaphragm from the axial direction.

According to the centrifugal compressor of the disclosure, it is possible to help prevent the assemblability of the centrifugal compressor including the bundle from being affected regardless of how the size of the discharge scroll is changed.

BRIEF DESCRIPTION OF DRAWINGS

The disclosure will be described with reference to the accompanying drawings, wherein like numbers reference like elements.

DESCRIPTION OF EMBODIMENTS

Hereinafter, embodiments for implementing a centrifugal compressor 1 according to the disclosure will be described with reference to the accompanying drawings. However, the disclosure is not limited to the embodiments.

Configuration of Centrifugal Compressor

Figure 1:
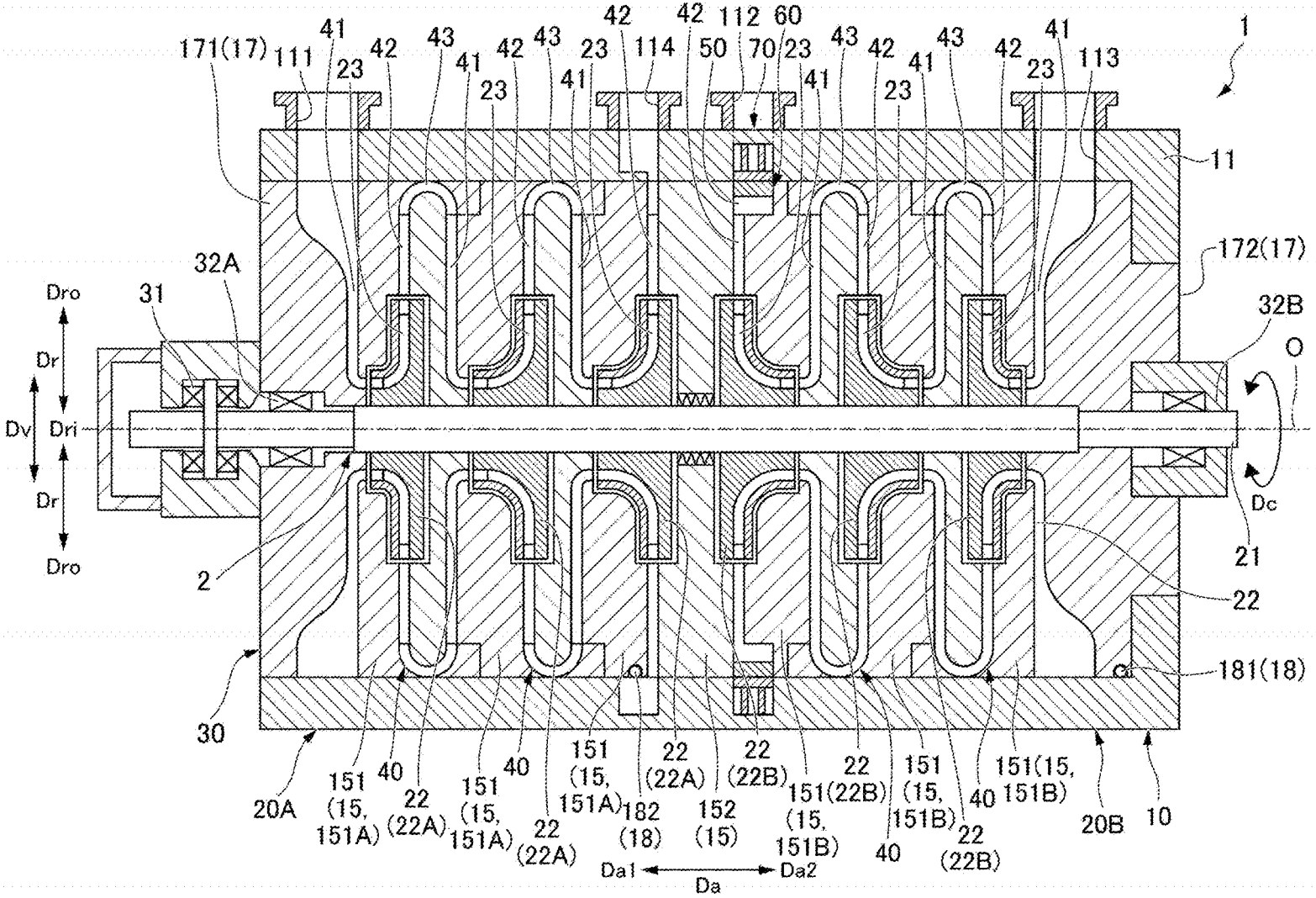
FIG. 1 is a cross-sectional view of a centrifugal compressor according to an embodiment of the disclosure.

As illustrated in FIG. 1, the centrifugal compressor 1 according to the present embodiment is a single-shaft multistage centrifugal compressor. The centrifugal compressor 1 mainly includes a rotor shaft 2 rotating about a central axis O and a casing 10 formed to surround the rotor shaft 2.

Configuration of Rotor Shaft

The rotor shaft 2 extends in an axial direction Da. The rotor shaft 2 extends so as to penetrate through the inside of the casing 10 along the central axis O. The rotor shaft 2 includes a rotor shaft main body 21 and an impeller 22.

Note that, in the present embodiment, a direction in which the central axis O extends is referred to as the axial direction Da. The axial direction Da of the rotor shaft 2 is along a horizontal plane. That is, the central axis O extends in the horizontal direction. A radial direction with respect to the central axis O is simply referred to as a radial direction Dr. A direction around the rotor shaft 2 about the central axis O is referred to as a circumferential direction Dc.

The rotor shaft main body 21 is formed in a columnar shape extending in the axial direction Da. An end portion of the rotor shaft main body 21 on a first side Da1 in the axial direction Da is supported by the casing 10 with a journal bearing 32A and a thrust bearing 31 so as to be rotatable about the central axis O. An end portion of the rotor shaft main body 21 on a second side Da2 in the axial direction Da is supported by the casing 10 with a journal bearing 32B so as to be rotatable about the central axis O.

The impeller 22 is disposed on an outer side Dro of the rotor shaft main body 21 in the radial direction Dr with respect to the central axis O. A plurality of impellers 22 are disposed so as to be separated from each other in the axial direction Da in the casing 10. In the present embodiment, for example, six impellers 22 are disposed at intervals in the axial direction Da. These impellers 22 constitute two sets of three-stage impeller groups 22A and 22B facing opposite sides to each other in the axial direction Da. Thus, the centrifugal compressor 1 of the present embodiment is a so-called back-to-back single-shaft multistage centrifugal compressor. The centrifugal compressor 1 includes a first compression portion 20A including the impeller group 22A and a second compression portion 20B including the impeller group 22B. In the centrifugal compressor 1, a working fluid compressed in the first compression portion 20A is further compressed in the second compression portion 20B.

Each impeller 22 compresses and discharges the working fluid (e.g., gas) supplied from the first side Da1 in the axial direction Da to the outer side Dro in the radial direction Dr. Each impeller 22 is formed therein with an impeller flow path 23. The cross-sectional area of the impeller flow path 23 gradually decreases from an inner side Dri in the radial direction Dr toward the outer side Dro in the radial direction Dr. Accordingly, the working fluid flowing through the impeller flow path 23 while the impeller 22 is rotating is gradually compressed to have a high pressure. Note that each impeller 22 may be a closed impeller including a cover or an open impeller including no cover.

Configuration of Casing

The casing 10 is formed so as to surround the rotor shaft main body 21 and the plurality of impellers 22 from the outer side Dro in the radial direction Dr. The casing 10 includes an outer casing 11, a suction port 111, a discharge port 112, an intermediate suction port 113, an intermediate discharge port 114, a plurality of diaphragms 15, a head 17, and a roller 18.

The outer casing 11 is formed in a tubular shape extending in the axial direction Da. The outer casing 11 is formed so as to cover the rotor shaft 2, the plurality of diaphragms 15, the head 17, and the roller 18 from the outer side Dro in the radial direction Dr. The outer casing 11 forms the suction port 111, the discharge port 112, the intermediate suction port 113, and the intermediate discharge port 114.

The suction port 111 is formed on the first side Da1 in the axial direction Da of the outer casing 11. The suction port 111 introduces the working fluid into the outer casing 11 from the outside.

The intermediate discharge port 114 is formed near the center of the outer casing 11 in the axial direction Da. The intermediate discharge port 114 is formed to be separated from the suction port 111 to the second side Da2 in the axial direction Da. The intermediate discharge port 114 is a discharge port in the first compression portion 20A. The intermediate discharge port 114 is connected to the impeller 22 located furthest toward the second side Da2 in the axial direction Da in the first compression portion 20A. The intermediate discharge port 114 discharges the working fluid compressed through the three impellers 22 of the first compression portion 20A in the outer casing 11 to the outside of the outer casing 11.

The intermediate suction port 113 is formed on the second side Da2 in the axial direction Da of the outer casing 11. The intermediate suction port 113 is formed so as to be separated from the intermediate discharge port 114 to the second side Da2 in the axial direction Da. The intermediate suction port 113 is a suction port in the second compression portion 20B. The intermediate suction port 113 is connected to the impeller 22 located furthest toward the second side Da2 in the axial direction Da in the second compression portion 20B. The intermediate suction port 113 causes the working fluid discharged from the intermediate discharge port 114 through the three impellers 22 of the first compression portion 20A in the outer casing 11 to flow into the impellers 22 of the second compression portion 20B.

The discharge port 112 is formed near the center of the outer casing 11 in the axial direction Da. The discharge port 112 is formed so as to be separated from the suction port 111 to the second side Da2 in the axial direction Da. In addition, the discharge port 112 is formed so as to be separated from the intermediate suction port 113 to the first side Da1 in the axial direction Da. The discharge port 112 is connected to the impeller 22 located furthest toward the first side Da1 in the axial direction Da in the second compression portion 20B. Thus, the discharge port 112 discharges the working fluid compressed through all the impellers 22 in the outer casing 11 to the outside of the outer casing 11.

The plurality of diaphragms 15 are disposed on the inner side Dri in the radial direction of the outer casing 11. The plurality of diaphragms 15 are formed in a tubular shape extending in the axial direction Da as a whole so as to cover the rotor shaft 2 from the outer side Dro in the radial direction Dr. The plurality of diaphragms 15 are fixed to each other to cover the circumference of the rotor shaft 2, and form therein a casing flow path 40 connecting the plurality of impellers 22. The plurality of diaphragms 15 include a plurality of diaphragm main bodies 151 and an intermediate wall 152.

The diaphragm main bodies 151 cover the impellers 22 in respective stages. Each diaphragm main body 151 is formed in a disc-like shape centered on the central axis O. The plurality of diaphragm main bodies 151 are stacked in the axial direction Da. The diaphragm main bodies 151 adjacent to each other are fixed to each other by welding or with a detachable fastening member.

The diaphragm main bodies 151 constitute two sets of three-stage diaphragm main body groups 151A and 151B separated from each other in the axial direction Da. Thus, in the present embodiment, the diaphragm main body group 151A covering the impeller group 22A in the first compression portion 20A and the diaphragm main body group 151B covering the impeller group 22B in the second compression portion 20B are provided.

The intermediate wall 152 is disposed between the two diaphragm main body groups 151A and 151B. The intermediate wall 152 covers the rotor shaft main body 21. The intermediate wall 152 seals a gap with the outer circumferential surface of the rotor shaft main body 21. The intermediate wall 152 is fixed to the diaphragm main bodies 151 by welding or with a detachable fastening member.

The plurality of diaphragms 15 constitute a bundle 30 together with the rotor shaft 2, the head 17, the journal bearings 32A and 32B, the thrust bearing 31, and the roller 18. The bundle 30 is accommodated in the outer casing 11 on the inner side Dri in the radial direction Dr so as to be insertable and removable in the axial direction Da. The bundle 30 is formed in a columnar shape extending in the axial direction Da. In the bundle 30, the plurality of diaphragms 15, the rotor shaft 2, the head 17, the journal bearings 32A and 32B, the thrust bearing 31, and the roller 18 are integrally movable.

Each of the plurality of diaphragms 15 includes an introduction flow path 41, a diffuser flow path 42, and a return flow path 43 as the casing flow path 40. The introduction flow path 41, the diffuser flow path 42, and the return flow path 43 are formed in each of the first compression portion 20A and the second compression portion 20B.

The introduction flow path 41 guides the working fluid from the outer side Dro in the radial direction Dr toward the inner side Dri in the radial direction Dr. The introduction flow path 41 changes the working fluid flowing toward the inner side Dri in the radial direction Dr so as to flow toward the second side Da2 in the axial direction Da, thereby guiding the working fluid to the impeller 22. In this way, the introduction flow path 41 changes the flow direction of the working fluid to the second side Da2 in the axial direction Da so as to guide the working fluid to the impeller flow path 23 of the impeller 22.

The diffuser flow path 42 extends from the inner side Dri toward the outer side Dro in the radial direction Dr. An end portion of the diffuser flow path 42 on the inner side Dri in the radial direction Dr communicates with an end portion of the impeller flow path 23 on the outer side Dro in the radial direction Dr. The diffuser flow path 42 guides the working fluid compressed by the impeller 22 from the inner side Dri in the radial direction Dr to the outer side Dro in the radial direction Dr.

The return flow path 43 inverts the flow direction of the working fluid having flowed from the inner side Dri in the radial direction Dr toward the outer side Dro in the radial direction Dr through the diffuser flow path 42. The return flow path 43 guides the working fluid flowing toward the outer side Dro in the radial direction Dr toward the inner side Dri in the radial direction Dr. One end (one side in the axial direction Da) of the return flow path 43, which is upstream in the flow direction of the working fluid, communicates with the diffuser flow path 42. The other end side (the opposite side in the axial direction Da) of the return flow path 43, which is downstream in the flow direction of the working fluid, communicates with the next introduction flow path 41.

A pair of heads 17 are disposed so as to close openings at both ends of the outer casing 11 having a tubular shape in the axial direction Da. The head 17 is an annular member centered on the central axis O. The pair of heads 17 are disposed inside the outer casing 11. The head 17 of the present embodiment includes a first casing head 171 and a second casing head 172.

The first casing head 171 is disposed so as to close the opening of the outer casing 11 on the first side Da1 in the axial direction Da. That is, the first casing head 171 is disposed adjacent to the plurality of diaphragms 15 on the first side Da1 in the axial direction Da. A suction scroll, which introduces an external working fluid into the casing flow path 40 via the suction port 111, is formed between the first casing head 171 and the diaphragm main body 151 of the first stage disposed furthest toward the first side Da1 in the axial direction Da out of the plurality of diaphragms 15. The first casing head 171 is fixed to the plurality of diaphragms 15, which are integrated with each other, by a detachable fastening member. Thus, the first casing head 171 is integrated with the plurality of diaphragms 15.

The second casing head 172 is disposed so as to close the opening of the outer casing 11 on the second side Da2 in the axial direction Da. That is, the second casing head 172 is disposed adjacent to the plurality of diaphragms 15 on the second side Da2 in the axial direction Da. Thus, the second casing head 172 is adjacent to the diaphragm main body 151 of the final stage disposed furthest toward the second side Da2 in the axial direction Da out of the plurality of diaphragms 15. The second casing head 172 is fixed to the plurality of diaphragms 15, which are integrated with each other, by a detachable fastening member. Thus, the second casing head 172 is integrated with the plurality of diaphragms 15.

The roller 18 is disposed below the bundle 30 in the vertical direction. The roller 18 is in contact with the inner circumferential surface of a lower portion of the outer casing 11 in a state in which the bundle 30 is inserted in the outer casing 11. The casing 10 of the present embodiment includes a first roller 181 and a second roller 182 as the roller 18.

The first roller 181 is disposed at an end portion of the bundle 30 on the second side Da2 in the axial direction Da. The first roller 181 is disposed at a leading end of the bundle 30 when the bundle 30 is inserted into the outer casing 11. That is, the first roller 181 is disposed below the second casing head 172. A plurality of first rollers 181 are disposed at intervals in the circumferential direction Dc around the central axis O with respect to the bundle 30 (see FIG. 3). The first roller 181 is disposed so as to be in contact with the inner circumferential surface of the lower portion of the outer casing 11 in a state in which the bundle 30 is inserted in the outer casing 11.

The second roller 182 is disposed so as to be separated from the first roller 181 to the first side Da1 in the axial direction Da. A plurality of second rollers 182 are disposed at intervals in the circumferential direction Dc with respect to the bundle 30 (see FIG. 3). The second roller 182 is disposed near the middle of the bundle 30 in the axial direction Da. The second roller 182 is disposed below the diaphragm main body 151 adjacent to the intermediate wall 152 on the first side Da1 in the axial direction Da. The second roller 182 is disposed so as to be in contact with the inner circumferential surface of the lower portion of the outer casing 11 in a state in which the bundle 30 is inserted in the outer casing 11. The second roller 182 is disposed at a position coincident with the position of the first roller 181 in the circumferential direction Dc with respect to the bundle 30.

Configuration of Discharge Scroll

Figure 2:
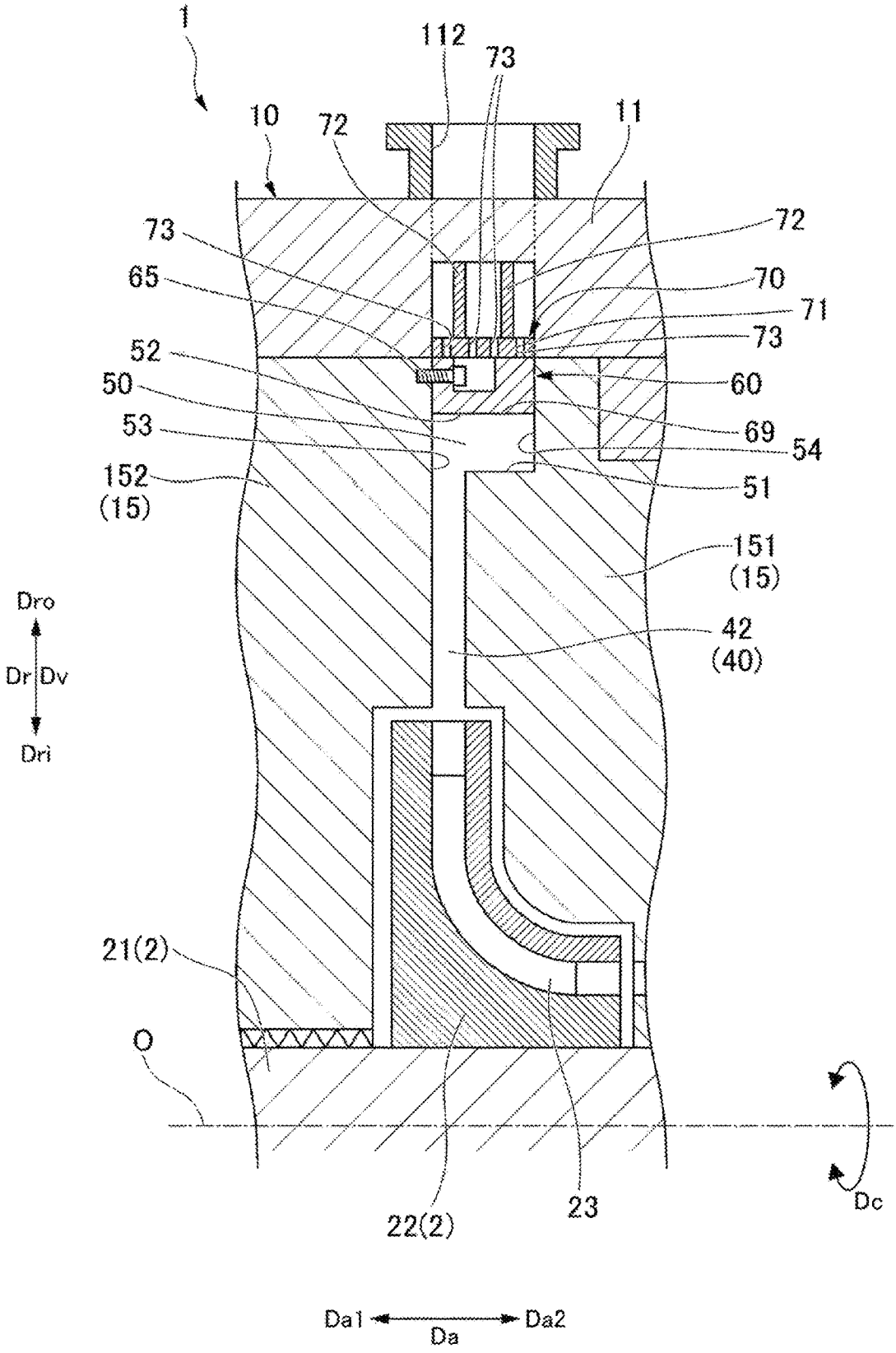
FIG. 2 is an enlarged cross-sectional view illustrating a configuration around a discharge scroll of the centrifugal compressor.
Figure 3:
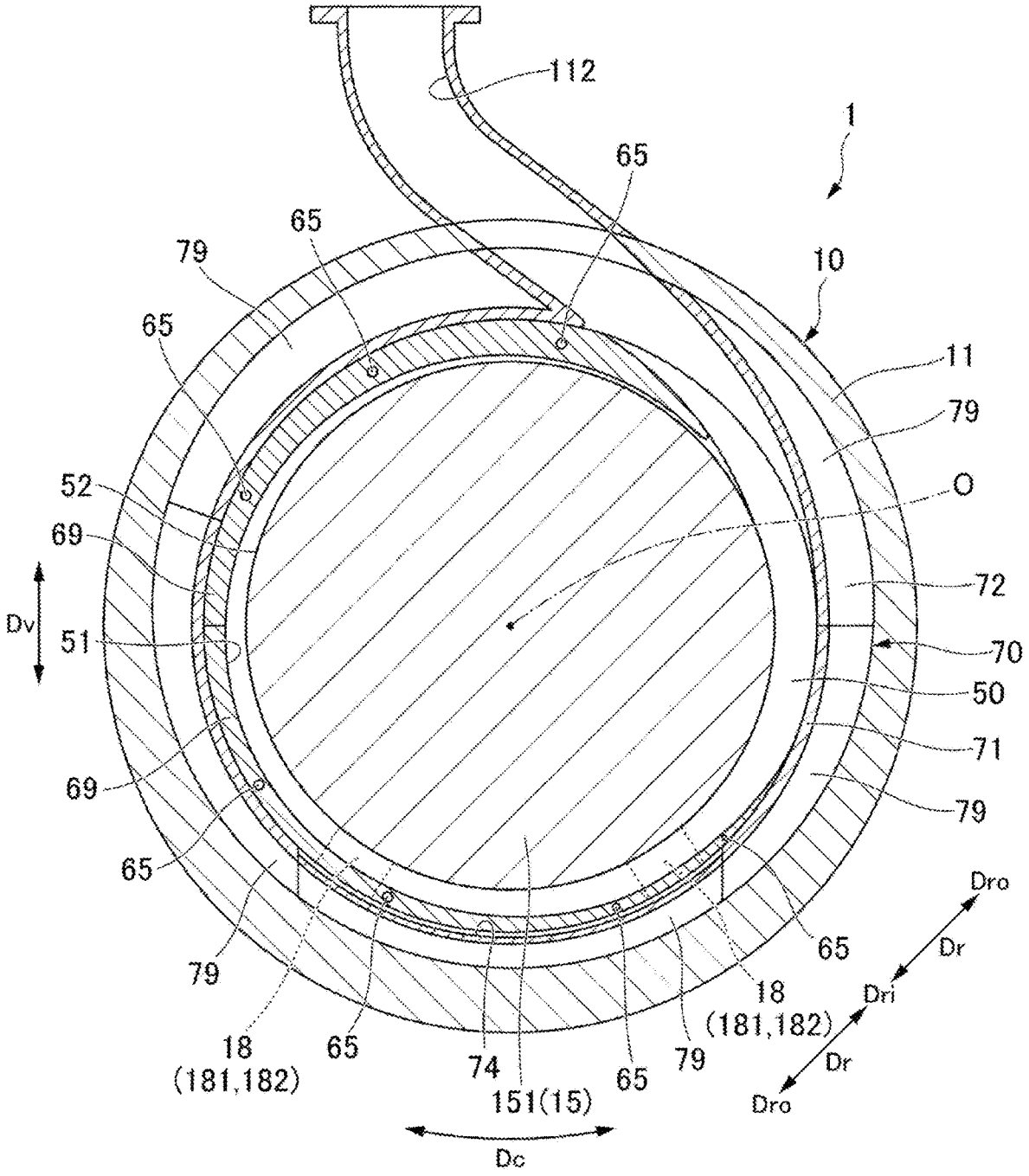
FIG. 3 is a cross-sectional view illustrating a state in which the discharge scroll of the centrifugal compressor is viewed from an axial direction.

The casing 10 of the centrifugal compressor 1 further includes a discharge scroll 50, a flow path forming member 60, and an outer forming member 70. The discharge scroll 50 guides the working fluid discharged from the impeller 22 to the discharge port 112. The discharge scroll 50 guides the working fluid compressed in each of the first compression portion 20A and the second compression portion 20B and discharged from the impeller 22 of the final stage to the discharge port 112. As illustrated in FIG. 2, the discharge scroll 50 is connected to the diffuser flow path 42 on the outer side Dro in the radial direction Dr. As illustrated in FIG. 3, the discharge scroll 50 extends in the circumferential direction Dc around the central axis O. The discharge scroll 50 is a flow path formed in a spiral shape over one round in the circumferential direction Dc around the central axis O. The discharge scroll 50 is connected to the diffuser flow path 42 on the inner side Dri in the radial direction Dr over the entire circumference. The discharge scroll 50 is connected, at a part thereof in the circumferential direction Dc, to the discharge port 112 on the outer side Dro in the radial direction Dr. The discharge scroll 50 is formed so as to change in spacing in the radial direction Dr when viewed from the axial direction Da. The discharge scroll 50 is formed such that only the spacing in the radial direction Dr decreases as the distance from the discharge port 112 in the circumferential direction Dc increases while the spacing in the axial direction Da remains constant. That is, the discharge scroll 50 is formed such that the spacing in the radial direction Dr is widest at a position closest to the discharge port 112 in the circumferential direction Dc. In the discharge scroll 50, the spacing in the radial direction Dr is gradually narrowed such that the flow velocity of the working fluid flowing inside becomes constant in the circumferential direction Dc.

As illustrated in FIG. 2, the discharge scroll 50 is configured with a space formed by the plurality of diaphragms 15, the outer casing 11, and the flow path forming member 60. The discharge scroll 50 of the present embodiment is formed in a space surrounded by the diaphragm main body 151, the intermediate wall 152, the outer casing 11, and the flow path forming member 60. The discharge scroll 50 is enclosed by a scroll inner circumferential surface 51 on the inner side Dri in the radial direction Dr, a scroll outer circumferential surface 52 on the outer side Dro in the radial direction Dr, a first flow path forming surface 53 disposed on the first side Da1 in the axial direction Da, and a second flow path forming surface 54 disposed on the second side Da2 in the axial direction Da.

The scroll inner circumferential surface 51 is located on the most inner side Dri in the radial direction Dr in the discharge scroll 50. The scroll inner circumferential surface 51 is a surface facing the outer side Dro in the radial direction Dr. The scroll inner circumferential surface 51 is formed by the diaphragm main body 151. The scroll inner circumferential surface 51 is disposed on the outer side Dro in the radial direction Dr of the diffuser flow path 42 when viewed from the circumferential direction Dc. The scroll inner circumferential surface 51 is disposed on the inner side Dri in the radial direction Dr of the boundary between the second casing head 172 as well as the diaphragm 15 and the outer casing 11 when viewed from the circumferential direction Dc.

The scroll outer circumferential surface 52 is located on the most outer side Dro in the radial direction Dr in the discharge scroll 50. The scroll outer circumferential surface 52 is a surface facing the inner side Dri in the radial direction Dr. The scroll outer circumferential surface 52 is opposed to the scroll inner circumferential surface 51 in the radial direction Dr. The scroll outer circumferential surface 52 is formed by the flow path forming member 60. The scroll outer circumferential surface 52 is disposed on the inner side Dri in the radial direction Dr of the outer casing 11 in the radial direction Dr. The scroll outer circumferential surface 52 is disposed on the inner side Dri in the radial direction Dr of the inner circumferential surface of the outer casing 11 when viewed from the circumferential direction Dc. The scroll outer circumferential surface 52 is formed such that the distance in the radial direction Dr between the scroll outer circumferential surface 52 and the scroll inner circumferential surface 51 decreases as the distance from the discharge port 112 in the circumferential direction Dc increases.

The first flow path forming surface 53 is located furthest toward the first side Da1 in the axial direction Da in the discharge scroll 50. The first flow path forming surface 53 is a surface facing the second side Da2 in the axial direction Da. The first flow path forming surface 53 is formed by the intermediate wall 152. The first flow path forming surface 53 is formed in a planar shape so as to be integrally connected to the surface forming the diffuser flow path 42 at the same position in the axial direction Da.

The second flow path forming surface 54 is located furthest toward the second side Da2 in the axial direction Da in the discharge scroll 50. The second flow path forming surface 54 is opposed to the first flow path forming surface 53 in the axial direction Da. The second flow path forming surface 54 is a surface facing the first side Da1 in the axial direction Da. The distance between the first flow path forming surface 53 and the second flow path forming surface 54 in the axial direction Da is constant at any position in the circumferential direction Dc. The second flow path forming surface 54 is formed by the diaphragm main body 151. The second flow path forming surface 54 extends from the scroll inner circumferential surface 51 toward the outer side Dro in the radial direction Dr.

The flow path forming member 60 includes the scroll outer circumferential surface 52. In the flow path forming member 60, the inner circumferential surface facing the inner side Dri in the radial direction Dr is the scroll outer circumferential surface 52 and forms a part of the discharge scroll 50. Thus, the flow path forming member 60 is disposed on the outer side Dro in the radial direction Dr of the discharge scroll 50. The flow path forming member 60 is formed to have an outside diameter smaller than the outside diameter of the bundle 30 in the radial direction Dr. The outer circumferential surface of the flow path forming member 60 of the present embodiment is disposed at the same position as the outer circumferential surfaces of the plurality of diaphragms 15 and the same position as the inner circumferential surface of the outer casing 11 when viewed from the circumferential direction Dc. The flow path forming member 60 extends in the circumferential direction Dc. The flow path forming member 60 is formed in a solid shape. As illustrated in FIG. 3, the flow path forming member 60 is formed in a plate-like shape that gradually becomes thinner in the circumferential direction Dc. When viewed from the axial direction Da, the flow path forming member 60 is not formed in an annular shape that covers the entire circumference of the rotor shaft 2, but is formed in an arc shape that covers half or more of the rotor shaft 2. The flow path forming member 60 is fixed to the diaphragm 15 from the axial direction Da. As illustrated in FIG. 2 and FIG. 3, the flow path forming member 60 of the present embodiment is detachably fixed to the intermediate wall 152 with bolts 65 at a plurality of locations separated from each other in the circumferential direction Dc. As illustrated in FIG. 3, the flow path forming member 60 is configured with a plurality of (two in the present embodiment) small flow path forming pieces 69 divided in the circumferential direction Dc. In the present embodiment, the flow path forming member 60 is configured with the small flow path forming piece 69 on the upper side in the vertical direction with respect to the central axis O and the small flow path forming piece 69 on the lower side in the vertical direction with respect to the central axis O when viewed from the axial direction Da. Each small flow path forming piece 69 is fixed with the bolts 65 at a plurality of locations.

As illustrated in FIG. 2, the outer forming member 70 is disposed between the outer casing 11 and the flow path forming member 60 in a state of being in contact with the flow path forming member 60 on the outer side Dro in the radial direction Dr. The outer forming member 70 is fixed to the outer casing 11. The outer forming member 70 is non-detachably fixed to the outer casing 11 by welding in the radial direction Dr. The outer forming member 70 supports the flow path forming member 60 with respect to the outer casing 11 in a state in which the flow path forming member 60 cannot move to the outer side Dro in the radial direction Dr. The outer forming member 70 is formed so as to cover the flow path forming member 60 from the outer side Dro in the radial direction Dr. A space is formed between the outer forming member 70 and the outer casing 11. As illustrated in FIG. 3, when viewed from the axial direction Da, the outer forming member 70 is not formed in an annular shape that covers the entire circumference of the rotor shaft 2, but is formed in an arc shape that is longer than the flow path forming member 60 in the circumferential direction Dc.

As illustrated in FIG. 2, the outer forming member 70 of the present embodiment includes a support member 71 and a fixing member 72. The support member 71 faces the flow path forming member 60. In the support member 71, the inner circumferential surface facing the inner side Dri in the radial direction Dr is in contact with the outer circumferential surface of the flow path forming member 60. That is, when viewed from the circumferential direction Dc, the inner circumferential surface of the support member 71 is disposed at the same position as the inner circumferential surface of the outer casing 11. The support member 71 that is in contact with the outer circumferential surface of the flow path forming member 60 is formed in a thin plate-like shape and extends in the circumferential direction Dc. The fixing member 72 fixes the support member 71 to the outer casing 11. The fixing member 72 extends in the radial direction Dr from a surface of the support member 71 facing the outer side Dro in the radial direction Dr. Two fixing members 72 are disposed so as to be separated from each other in the axial direction Da. The fixing members 72 are formed integrally with the support member 71. The fixing members 72 are fixed to the inner circumferential surface of the outer casing 11 by welding.

The outer forming member 70 includes a through-hole 73. The through-hole 73 extends through the support member 71 in the radial direction Dr. Since the through-hole 73 extends through the support member 71, a space in which the flow path forming member 60 is disposed and a space between the support member 71 and the outer casing 11 communicate with each other. A plurality of through-holes 73 are disposed so as to be separated from each other in the circumferential direction Dc and in the axial direction Da.

Further, as illustrated in FIG. 3, the outer forming member 70 is configured with a plurality of (five in the present embodiment) small outer forming pieces 79 divided in the circumferential direction Dc. The small outer forming piece 79 is welded to be fixed to the outer casing 11.

The outer forming member 70 further includes a recessed portion 74. The recessed portion 74 is recessed in the radial direction Dr at the same position as the roller 18 in the circumferential direction Dc when viewed from the axial direction Da. The recessed portion 74 is recessed from the surface of the support member 71 facing the inner side Dri in the radial direction Dr. The recessed portion 74 is formed with a constant length in the circumferential direction Dc so as to be overlapped with a region in which the plurality of first rollers 181 and the plurality of second rollers 182 are disposed when viewed from the axial direction Da. The recessed portion 74 of the present embodiment is formed in the support member 71 of the small outer forming piece 79 located at the lowermost position in the vertical direction out of the plurality of small outer forming pieces 79.

Operational Effects

In the centrifugal compressor 1 having the above-described configuration, the working fluid discharged from the impeller 22 of the final stage passes through the diffuser flow path 42 of the final stage and flows into the discharge scroll 50. In the discharge scroll 50, the scroll outer circumferential surface 52 located on the outer side Dro in the radial direction Dr is formed by the flow path forming member 60. The flow path forming member 60 is formed as a separate member from the outer casing 11 and the plurality of diaphragms 15. Thus, the size of the discharge scroll 50 can be changed by changing the size of the flow path forming member 60 without changing the shapes of the outer casing 11 and the plurality of diaphragms 15.

Further, since the flow path forming member 60 is a plate-like member extending in the circumferential direction Dc, the scroll outer circumferential surface 52 also has a shape smoothly extending in the circumferential direction Dc. Accordingly, the working fluid having flowed from the diffuser flow path 42 can be caused to smoothly flow to the discharge port 112 by the scroll outer circumferential surface 52 of the flow path forming member 60. As a result, the performance of the scroll flow path can be ensured.

In addition, the flow path forming member 60 is formed to have an outside diameter smaller than the outside diameter of the bundle 30 in the radial direction Dr, and is fixed to the intermediate wall 152 from the axial direction Da. Thus, regardless of how the size of the discharge scroll 50 is changed, the flow path forming member 60 does not protrude to the outer side Dro of the plurality of diaphragms 15 in the radial direction Dr. That is, regardless of how the size of the discharge scroll 50 is changed, the flow path forming member 60 does not interfere with the outer casing 11. Accordingly, the assemblability at the time of insertion and removal of the bundle 30 into and from the outer casing 11 is not impaired. As a result, it is possible to prevent the assemblability of the centrifugal compressor 1 including the bundle 30 from being affected regardless of how the size of the discharge scroll 50 is changed.

In addition, the flow path forming member 60 is formed in a solid shape. This can help prevent the flow path forming member 60 from being deformed even when the working fluid discharged from the impeller 22 of the final stage and having a high pressure flows into the discharge scroll 50. Accordingly, this can help prevent the scroll outer circumferential surface 52 formed by the flow path forming member 60 from being deformed. Further, the flow path forming member 60 is configured with the plurality of small flow path forming pieces 69. Thus, even with the flow path forming member 60 having a solid shape and thus having an increased weight, it is easy to assemble and disassemble the flow path forming member 60 to and from the intermediate wall 152.

In addition, the outer forming member 70 fixed to the outer casing 11 is disposed between the outer casing 11 and the flow path forming member 60. Thus, even when the flow path forming member 60 is formed to have a minimum thickness for forming the scroll outer circumferential surface 52, the flow path forming member 60 can be supported by the outer casing 11 via the outer forming member 70. Accordingly, regardless of how the size of the discharge scroll 50 is changed, the flow path forming member 60 can be prevented from being deformed due to the high-pressure fluid flowing into the discharge scroll 50. As a result, it is possible to change the size of the discharge scroll 50 while maintaining stable performance by changing the shape of the flow path forming member 60 without remaking the outer casing 11 and the plurality of diaphragms 15 for the existing centrifugal compressor 1.

The outer forming member 70 including the support member 71 facing the flow path forming member 60 is disposed on the outer side Dro in the radial direction Dr of the flow path forming member 60 and is formed to be long in the circumferential direction Dc so as to cover the flow path forming member 60. Thus, the outer forming member 70 is likely to be larger and heavier than the flow path forming member 60. However, in the present embodiment, a space is formed between the outer forming member 70 and the outer casing 11. That is, it is possible to form the outer forming member 70 in a hollow shape while supporting the flow path forming member 60 with the support member 71. Accordingly, the weight of the outer forming member 70 can be reduced.

In particular, in the present embodiment, the outer forming member 70 is configured with the plurality of small outer forming pieces 79. Thus, even with the outer forming member 70 having a large size and an increased weight, the assembly and the disassembly thereof are further facilitated.

In addition, the outer forming member 70 is formed with the plurality of through-holes 73. Thus, the space formed between the flow path forming member 60 and the outer casing 11 and the space in which the flow path forming member 60 is disposed are connected to each other via the through-holes 73. This makes it possible to suppress the generation of a pressure differential between the space formed between the flow path forming member 60 and the outer casing 11 and the space in which the flow path forming member 60 is disposed. Accordingly, the deformation of the support member 71 due to the pressure differential can be suppressed. As a result, even when the outer casing 11 is hollow, the flow path forming member 60 can be stably supported.

In inserting the bundle 30 into the outer casing 11, the first roller 181 and the second roller 182 are kept in contact with the inner circumferential surface of the lower portion of the outer casing 11. The outer forming member 70 includes the recessed portion 74 in a region overlapping with the first roller 181 and the second roller 182 in the circumferential direction Dc when viewed from the axial direction Da. The recessed portion 74 is recessed in the radial direction Dr at the same position as the first roller 181 and the second roller 182. Thus, when the first roller 181 and the second roller 182 move over the outer forming member 70 in the axial direction Da, the recessed portion 74 allows the first roller 181 and the second roller 182 to pass through the outer forming member 70 without coming into contact with the outer forming member 70. Accordingly, it is possible to help prevent the weight of the bundle 30 from being applied to the outer forming member 70 via the first roller 181 and the second roller 182. As a result, the deformation of the support member 71 can be suppressed.

Other Embodiments

Although the embodiment of the disclosure has been described in detail with reference to the accompanying drawings, specific configurations are not limited to the embodiment, and include design modifications and the like without departing from the gist of the disclosure.

Note that the centrifugal compressor 1 is not limited to having the configuration including the outer forming member 70. That is, the centrifugal compressor 1 may include only the flow path forming member 60 without including the outer forming member 70.

In addition, the flow path forming member 60 and the outer forming member 70 are not limited to being disposed only at the discharge port 112. For example, in a case where the intermediate discharge port 114 is provided as in the centrifugal compressor 1 of the present embodiment, the flow path forming member 60 and the outer forming member 70 may also be disposed at the intermediate discharge port 114 in addition to the discharge port 112.

In addition, the centrifugal compressor 1 is not limited to being a back-to-back single shaft multistage centrifugal compressor. The centrifugal compressor 1 may be a straight single shaft multistage centrifugal compressor in which all the impellers 22 face the same direction.

In addition, the flow path forming member 60 and the outer forming member 70 are not limited to having a divided structure configured with a plurality of members. The flow path forming member 60 and the outer forming member 70 may be formed of one member.

Supplementary Notes

The centrifugal compressor 1 according to the embodiment described above can be understood as follows, for example.

(1) A centrifugal compressor 1 according to a first aspect includes: a rotor shaft 2 extending in an axial direction Da in which a central axis O extends; and a casing 10 including a suction port 111 formed on a first side Da1 in the axial direction Da and a discharge port 112 formed on a second side Da2 in the axial direction Da. The rotor shaft 2 includes an impeller 22 disposed inside the casing 10 and configured to compress a working fluid supplied from the first side Da1 in the axial direction Da and discharge the compressed working fluid to an outer side Dro in a radial direction Dr with respect to the central axis O. The casing 10 includes: a diaphragm 15 formed in a tubular shape extending in the axial direction Da so as to cover the rotor shaft 2; an outer casing 11 formed in a tubular shape extending in the axial direction Da so as to cover the diaphragm 15; a diffuser flow path 42 configured to guide the working fluid discharged from the impeller 22 toward the outer side Dro in the radial direction Dr; a discharge scroll 50 configured to guide the working fluid discharged from the impeller 22 to the discharge port 112; and a flow path forming member 60 including a scroll outer circumferential surface 52, the scroll outer circumferential surface 52 being located on the outer side Dro in the radial direction Dr and facing an inner side Dri in the radial direction Dr in the discharge scroll 50. The discharge scroll 50 is connected to the diffuser flow path 42 on the outer side Dro in the radial direction Dr and extends in a circumferential direction Dc about the central axis O. The rotor shaft 2 and the diaphragm 15 form a bundle 30 formed in a columnar shape extending in the axial direction Da, the bundle 30 being accommodated in the outer casing 11 in a state of being insertable and removable in the axial direction Da on the inner side Dri in the radial direction Dr. The flow path forming member 60 is formed to have an outside diameter smaller than an outside diameter of the diaphragm 15 in the radial direction Dr, extends in the circumferential direction Dc, and is fixed to the diaphragm 15 from the axial direction Da.

According to this configuration, the flow path forming member 60 is formed as a separate member from the outer casing 11 and a plurality of diaphragms 15. Thus, the size of the discharge scroll 50 can be changed by changing the size of the flow path forming member 60 without changing the shapes of the outer casing 11 and the plurality of diaphragms 15.

Further, since the flow path forming member 60 is a member extending in the circumferential direction Dc, the scroll outer circumferential surface 52 also has a shape smoothly extending in the circumferential direction Dc. Accordingly, the working fluid having flowed from the diffuser flow path 42 can be caused to smoothly flow to the discharge port 112 by the scroll outer circumferential surface 52 of the flow path forming member 60. As a result, the performance of the scroll flow path can be ensured.

In addition, the flow path forming member 60 is formed to have an outside diameter smaller than the outside diameter of the bundle 30 in the radial direction Dr, and is fixed to the diaphragm 15 from the axial direction Da. Thus, regardless of how the size of the discharge scroll 50 is changed, the flow path forming member 60 does not protrude to the outer side Dro of the plurality of diaphragms 15 in the radial direction Dr. That is, regardless of how the size of the discharge scroll 50 is changed, the flow path forming member 60 does not interfere with the outer casing 11. Accordingly, the assemblability at the time of insertion and removal of the bundle 30 into and from the outer casing 11 is not impaired. As a result, it is possible to prevent the assemblability of the centrifugal compressor 1 including the bundle 30 from being affected regardless of how the size of the discharge scroll 50 is changed.

(2) A centrifugal compressor 1 according to a second aspect is the centrifugal compressor 1 of (1), wherein the flow path forming member 60 is formed in a solid shape and configured with a plurality of small flow path forming pieces 69 divided in the circumferential direction Dc.

According to this configuration, the flow path forming member 60 is formed in a solid shape. This can help prevent the flow path forming member 60 from being deformed, even when the working fluid discharged from the impeller 22 and having a high pressure flows into the discharge scroll 50. Accordingly, this can prevent the scroll outer circumferential surface 52 formed by the flow path forming member 60 from being deformed. Further, the flow path forming member 60 is configured with the plurality of small flow path forming pieces 69. Thus, even with the flow path forming member 60 having a solid shape and thus having an increased weight, it is easy to assemble and disassemble the flow path forming member 60 to and from the diaphragm 15.

(3) A centrifugal compressor 1 according to a third aspect is the centrifugal compressor 1 of (1) or (2), wherein the casing 10 further includes an outer forming member 70 disposed between the outer casing 11 and the flow path forming member 60 and fixed to the outer casing 11 in a state of being in contact with the flow path forming member 60 on the outer side Dro in the radial direction Dr.

According to this configuration, even when the flow path forming member 60 is formed to have a minimum thickness for forming the scroll outer circumferential surface 52, the flow path forming member 60 can be supported by the outer casing 11 via the outer forming member 70. Accordingly, regardless of how the size of the discharge scroll 50 is changed, the flow path forming member 60 can be prevented from being deformed due to the high-pressure fluid flowing into the discharge scroll 50. As a result, it is possible to change the size of the discharge scroll 50 while maintaining stable performance by changing the shape of the flow path forming member 60 without remaking the outer casing 11 and the plurality of diaphragms 15 for the existing centrifugal compressor 1.

(4) A centrifugal compressor 1 according to a fourth aspect is the centrifugal compressor 1 of (3), wherein the outer forming member 70 includes a support member 71 facing the flow path forming member 60 and forms a space between the outer forming member 70 and the outer casing 11.

According to this configuration, the outer forming member 70 can be formed in a hollow shape while the flow path forming member 60 is supported with the support member 71. Accordingly, the weight of the outer forming member 70 can be reduced.

(5) A centrifugal compressor 1 according to a fifth aspect is the centrifugal compressor 1 of (4), wherein the outer forming member 70 includes a through-hole 73 extending through the support member 71 in the radial direction Dr.

According to this configuration, the through-hole 73 can help prevent the generation of a pressure differential between the space formed between the outer forming member 70 and the outer casing 11 and the space in which the flow path forming member 60 is disposed. Accordingly, the deformation of the support member 71 due to the pressure differential can be suppressed. As a result, even when the outer casing 11 is hollow, the flow path forming member 60 can be stably supported.

(6) A centrifugal compressor 1 according to a sixth aspect is the centrifugal compressor 1 of any one of (2) to (5), wherein the casing 10 further includes a roller 18 disposed below the bundle 30 in the vertical direction and in contact with an inner circumferential surface of a lower portion of the outer casing 11 in a state in which the bundle 30 is inserted in the outer casing 11, and the outer forming member 70 includes a recessed portion 74 recessed in the radial direction Dr at the same position as the roller 18 in the circumferential direction Dc when viewed from the axial direction Da.

According to this configuration, when the roller 18 moves over the outer forming member 70 in the axial direction Da, the recessed portion 74 allows the roller 18 to pass through the outer forming member 70 without coming into contact with the outer forming member 70. Accordingly, it is possible to help prevent the weight of the bundle 30 from being applied to the outer forming member 70 via the roller 18. As a result, the deformation of the support member 71 can be suppressed.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A centrifugal compressor comprising:

a rotor shaft extending in an axial direction in which a central axis extends; and a casing including a suction port formed on a first side in the axial direction and a discharge port formed on a second side in the axial direction, wherein the rotor shaft includes an impeller disposed inside the casing and configured to compress a working fluid supplied from the first side in the axial direction and discharge the compressed working fluid to an outer side in a radial direction with respect to the central axis, the casing includes:

a diaphragm formed in a tubular shape extending in the axial direction so as to cover the rotor shaft;

an outer casing formed in a tubular shape extending in the axial direction so as to cover the diaphragm;

a diffuser flow path configured to guide the working fluid discharged from the impeller toward the outer side in the radial direction;

a discharge scroll configured to guide the working fluid discharged from the impeller to the discharge port; and a flow path forming member including a scroll outer circumferential surface, the scroll outer circumferential surface being located on the outer side in the radial direction and facing an inner side in the radial direction in the discharge scroll, the discharge scroll is connected to the diffuser flow path on the outer side in the radial direction and extending in a circumferential direction about the central axis, the rotor shaft and the diaphragm form a bundle formed in a columnar shape extending in the axial direction, the bundle being accommodated in the outer casing in a state of being insertable and removable in the axial direction on the inner side in the radial direction, the flow path forming member is formed to have an outside diameter smaller than an outside diameter of the bundle in the radial direction, extends in the circumferential direction, and is fixed to the diaphragm from the axial direction, and the casing further includes an outer forming member disposed between the outer casing and the flow path forming member and fixed to the outer casing in a state of being in contact with the flow path forming member on the outer side in the radial direction.

2. The centrifugal compressor according to claim 1, wherein the flow path forming member is formed in a solid shape and configured with a plurality of small flow path forming pieces divided in the circumferential direction.

3. The centrifugal compressor according to claim 1, wherein the outer forming member includes a support member facing the flow path forming member and forms a space between the outer forming member and the outer casing.

4. The centrifugal compressor according to claim 3, wherein the outer forming member includes a through-hole extending through the support member in the radial direction.

5. The centrifugal compressor according to claim 1, wherein the casing further includes a roller disposed below the bundle in a vertical direction and in contact with an inner circumferential surface of a lower portion of the outer casing in a state in which the bundle is inserted in the outer casing, and the outer forming member includes a recessed portion recessed in the radial direction at a same position as the roller in the circumferential direction when viewed from the axial direction.

* * * * *